US005868601A

United States Patent [19]

Kelemencky

[11] Patent Number: 5,868,601

[45] Date of Patent: Feb. 9, 1999

[54] CLEAVAGE CREATING AND/OR ENHANCING BRASSIERE

[76] Inventor: Monroe R. Kelemencky, P.O. Box 5008, Woodbury, Conn. 06798

[21] Appl. No.: 4,337

[22] Filed: Jan. 8, 1998

Related U.S. Application Data

[60] Provisional application No. 60/035,083 Jan. 9, 1997.

[51] Int. Cl.[6] ..... A41C 3/00; A41C 3/12

[52] U.S. Cl. ..... 450/59; 450/60; 450/64; 2/73

[58] Field of Search ..... 2/73, 105, 106, 2/67, 69, 69.5, 52, 46, 115, 113, 114; 450/8, 9, 10, 11, 14, 17, 12, 79, 80, 64, 68, 59, 62, 63, 71, 72, 60

[56] References Cited

U.S. PATENT DOCUMENTS 599,180 2/1898 Harrison .
1,655,224 1/1928 Hirsch .
2,641,763 6/1953 Schroeder .
2,908,276 10/1959 May .
3,196,878 7/1965 Hedu .
3,814,107 6/1974 Greenblatt et al. .
4,325,378 4/1982 Wilkinson .
4,412,357 11/1983 Mincher .
4,955,846 9/1990 Greenberg .

*Primary Examiner*—Jeanette Chapman
*Attorney, Agent, or Firm*—Richard C. Litman

[57] ABSTRACT

A cleavage creating and/or enhancing brassiere which in the preferred embodiment uses a pair of support straps with hook-and-loop-type fasteners to pull the breasts together and create and/or enhance a cleavage line. Each of the support straps has two ends, one end being fixed to a breast pocket and the other being adjustably connected to the opposite breast pocket. The support straps can be configured so that they may be fastened horizontally or in a criss-cross manner. The brassiere may further comprise a pair of breast-lifting and directing pads inserted into a respective breast pocket, or alternatively may be used in lieu of the support straps.

9 Claims, 3 Drawing Sheets

10
14
38
28
20
16
30
24
34
12
22
32
36
26

CLEAVAGE CREATING AND/OR ENHANCING BRASSIERE

CROSS-REFERENCE TO RELATED APPLICATION

This application claims the benefit of U.S. Provisional Patent Application Ser. No. 60/035,083, filed Jan. 9, 1997.

BACKGROUND OF THE INVENTION

1. Field of the Invention

The present invention relates to cleavage enhancing brassieres, and more particularly to a cleavage enhancing brassiere which uses support straps with hook-and-loop-type fasteners or other fasteners to pull the breasts together to enhance the cleavage line.

2. Description of Related Art

For many years women have been looking for a brassiere which is flattering to their figure and gives the illusion of enlarged breast size. The best way to obtain these results is to create and/or enhance the cleavage line. The current method of creating and/or enhancing the cleavage line is by using a specially designed brassiere to simply lift the breasts. However, this method has had limited success because in order for this method to be successful in accomplishing its goal the woman must be fairly well endowed.

For those women for whom the current cleavage creating and/or enhancing method does not work, there is a need for a brassiere which creates and/or enhances the cleavage line by pulling the breasts toward one another in a horizontal and/or upward manner. The brassiere must be capable of creating and/or enhancing the cleavage line while keeping its structure concealed from an observer, even when wearing a blouse or a dress. The cleavage creating and/or enhancing brassiere must also be capable of being made in a wide variety of styles and sizes.

The following patents describe brassieres or bosom-pads which are either flattering to the figure or give the illusion of enlarged breast size. U.S. Pat. No. 599,180, issued on Feb. 15, 1898, to Dora Harrison describes a bosom-pad that can be inflated to enhance the appearance of size of the breasts which allows adjustment of the distance between the breast cups according to the location of the natural breasts of the wearer. U.S. Pat. No. 1,655,224, issued on Jan. 3, 1928, to Joseph Hirsch describes a brassiere which is adjustable by means of straps which tie in the front to support the bust and to bring out the contour of the body. U.S. Pat. No. 3,196,878, issued on Jul. 27, 1965, to Jon Hedu describes a brassiere having an adjustable connection immediately between the breast cups which can be used to adjust the angular positioning of the cups to conform to the physique of the wearer. U.S. Pat. No. 4,955,846, issued on Sep. 11, 1990, to Bert Greenberg describes a brassiere with a size and configuration adjustment mechanism. The size and shape adjustments are made by using two layers of front, centerline fasteners. The fasteners can also be used to create a plunging neckline. The above listed patents fail to describe a brassiere which can be used to create and/or enhance the cleavage line of the wearer by pulling the breast cups toward one another in a horizontal manner and/or in an upward manner.

U.S. Pat. No. 4,325,378, issued on Apr. 20, 1982, to Margaret Wilkinson describes a sports garment which is comprised of two liners which cover the breasts. The outer liner flap is adjustable by means of a strap with a hook-and-loop-type fastener and a loop. Acting as a cinch, the outer flap provides support, inhibits breast movement while jogging, and can be adjusted during exercise without the need for privacy. The patent to Wilkinson fails to describe a brassiere which can be used to create and/or enhance the cleavage line of the wearer by pulling the breast cups toward one another and in an upward direction. The patent to Wilkinson also describes a structure which would be difficult, if not impossible, to conceal from an observer.

None of the above inventions and patents, taken either singularly or in combination, is seen to describe the instant invention as claimed. Thus a cleavage enhancing brassiere solving the aforementioned problems is desired.

SUMMARY OF THE INVENTION

The concept of the invention envisions that the brassiere is properly worn as a conventional brassiere where the two breast pockets contain and support both breasts. Then, once the breasts are firmly contained within their respective pockets, the breasts are pulled toward each other in a horizontal and/or upward direction by the adjustable straps located between the breast pockets so as to create and/or enhance the visible cleavage line between the two breasts.

In the preferred embodiment of the present invention a pair of support straps with hook-and-loop-type fasteners or other fastening means are used to pull the breasts together and create and/or enhance the cleavage line. Each of the support straps has two ends, one end being fixed to a breast pocket and the other being adjustably connected to the opposite breast pocket. The support straps can be configured so that they may be fastened horizontally or in a criss-crossed manner. Additionally, the invention may alternatively or further include a pair of pads removably or permanently inserted into a respective pocket to direct the breasts toward each other.

Accordingly, it is a principal object of the invention to provide a brassiere which creates and/or enhances the cleavage line between the breasts by pulling them towards one another.

It is another object of the invention to provide a brassiere which further enhances the cleavage line between the breasts by pulling them in an upward manner towards one another.

It is a further object of the invention to provide a brassiere which creates and/or enhances the cleavage line while its structure remains inconspicuous to an observer.

Still another object of the invention is to provide a brassiere which creates and/or enhances the cleavage line and which can be used with a wide variety of brassiere styles and sizes.

It is an object of the invention to provide improved elements and arrangements thereof in a cleavage enhancing brassiere for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
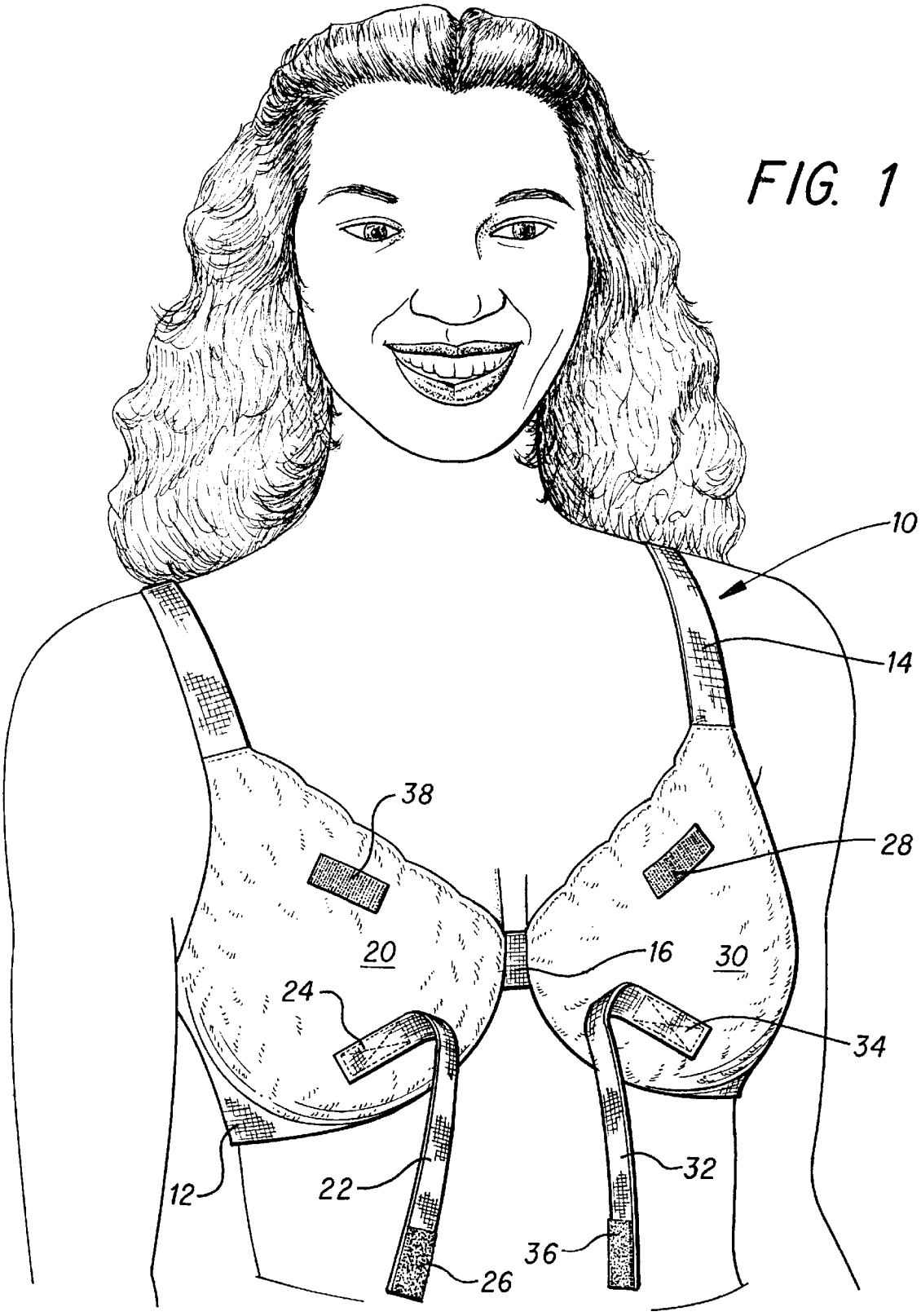
FIG. 1 is an environmental view of the first embodiment of the present invention showing the cleavage enhancing brassiere with the support straps in the disconnected position.

Referring to the drawings wherein like numerals represent like elements, FIG. 1 shows the present invention being used on a conventional brassiere 10. The brassiere 10 has a torso-encircling band 12 with a bridging piece 16 between the breast pockets, 20 and 30, which are integrally connected to the band 12. The wearer's breasts are firmly held within the brassiere by the breast pockets, 20 and 30. The brassiere 10 shown in FIGS. 1, 2 and 3, has shoulder straps 14, although it is contemplated that the present invention may also be used with a brassiere that does not have shoulder straps.

Figure 2:
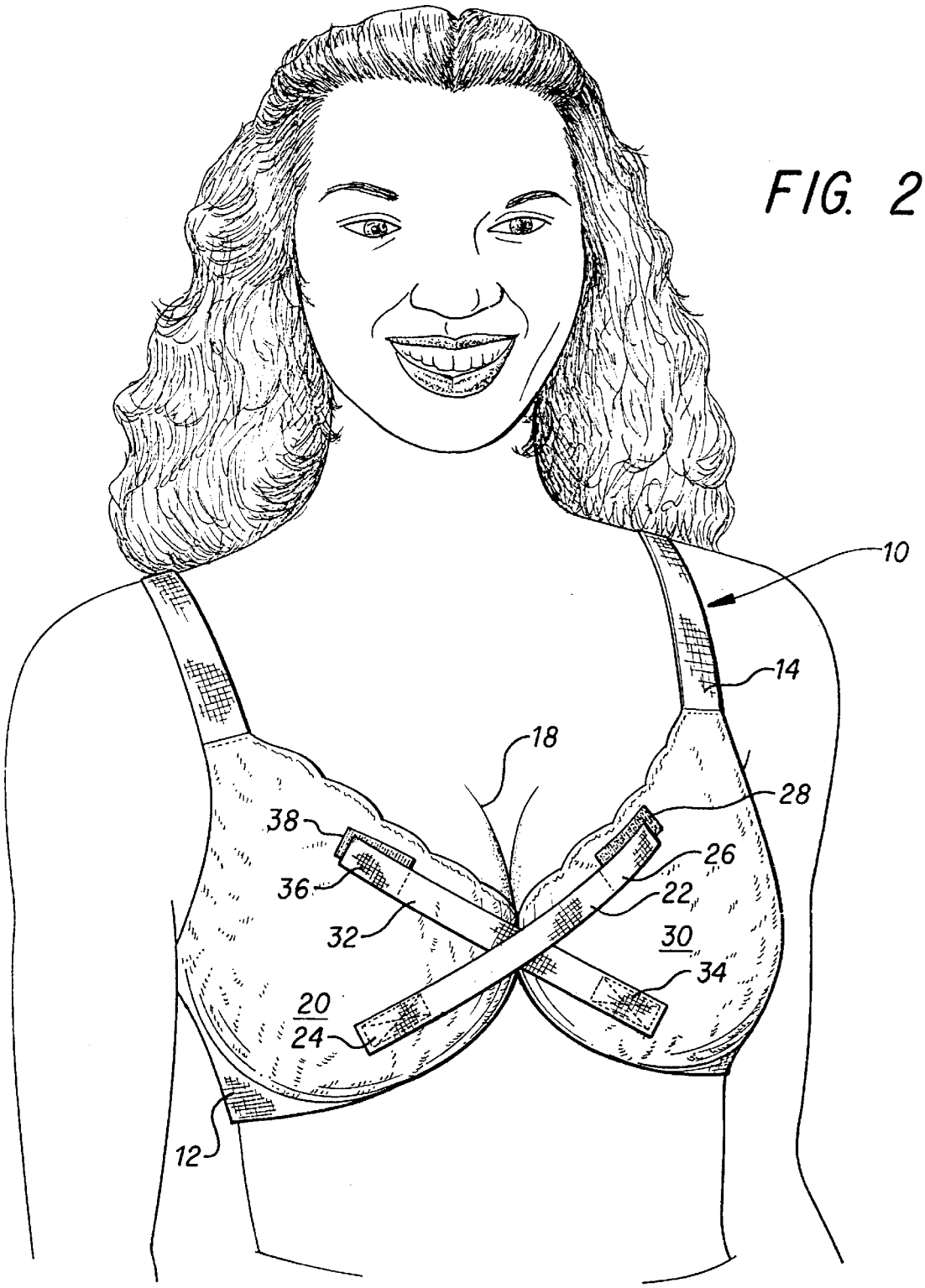
FIG. 2 is an environmental view of the first embodiment of the present invention showing the support straps in the connected position.

FIGS. 1 and 2 show the first embodiment of the present invention in which the support straps, 22 and 32, are in a criss-crossed configuration. This type of configuration not only pulls the breast pockets, 20 and 30, and the breasts towards each other but it also lifts them upwards to further create and/or enhance the cleavage line 18. The upward lifting effect created by the criss-crossed configuration of support straps 22 and 32 will have a more dramatic effect if it is used on a brassiere 10 that has shoulder straps 14 due to the fact that the extra weight placed on the breast pockets will be directly transferred to the shoulders of the wearer.

In the first embodiment the first support strap 22 is connected at one end thereof to breast pocket 20 by stitching 24. Similarly, one end of the second support strap 32 is connected to breast pocket 30 by stitching 34. The support straps, 22 and 32, have one component of a hook-and-loop-type fastener, 26 and 36 respectively, located on their free ends. The complimentary component 28 of the hook-and-loop-type fastener for support strap 22 is located above where support strap 32 is connected to breast pocket 30. The complimentary component 38 of the hook-and-loop-type and loop fastener 38 for support strap 32 is located above where support strap 22 is connected to breast pocket 20. Components 28 and 38 of the hook-and-loop-type fasteners are larger in size than complimentary components 26 and 36, or vice versa, in order to give the wearer the ability to adjust the tension in the support straps, 22 and 32. The tension in the support straps, 22 and 32, can be adjusted to adapt to the particular size and shape characteristics of the wearer and to allow the wearer to select the proper intensity of cleavage created and/or enhanced.

One consideration in selecting a suitable support strap and fastener is the ability of the support strap and fastener to conceal their structure to an observer. The hook-and-loop-type fasteners should be made as thin as possible so as not to protrude and cause visible deformation of the shirt or blouse of the wearer. The location at which the support straps, 22 and 32, are attached to their respective breast pockets, 20 and 30, can be varied to take into account the need to conceal their structure. By positioning the stitching, 24 and 34, of the support straps, 22 and 32, toward the lower edge of the breast pockets, 20 and 30, the structure of the support straps will be hard to detect. Additionally, the location of the hook-and-loop-type components, 28 and 38, on the breast pockets, 30 and 20 respectively, can be varied in order to conceal their structure.

It should be noted that any number of adjustable fastening mechanisms can be used as part of the present invention. A series of button holes or snap holes can be positioned along the support straps, 22 and 32, which fasten to matching buttons or snaps on the breast pockets, 30 and 20 respectively, where the hook-and-loop-type components, 28 and 38 respectively, are located in FIG. 1.

The support straps, 22 and 32, may be made from either an elastic or a non-elastic material. The non-elastic material will give the wearer greater pull and lift while the elastic material will provide some "give" and thereby add comfort for some wearers by allowing some breast movement while the brassiere is being worn. Preferably, the straps, 22 and 32, should be made from a relatively thin and narrow piece of fabric in order to help conceal its structure to an observer.

The torso encircling band 12 can also be made with a slight degree of elasticity in order to allow the breast pockets, which are integrally connected to the band, to move towards one another. By making the band 12 slightly elastic, the brassiere will not become too tight on the wearer when the support straps, 22 and 32, are used to pull the breast pockets, 20 and 30, together as shown in FIG. 2. Preferably, the bridging piece 16 located between the breast pockets, 20 and 30, should be made from a soft, non-rigid material so that it will not become uncomfortable when it is pinched between the breasts of the wearer. The bridging piece 16 may also be made of an elastic material.

Figure 3:
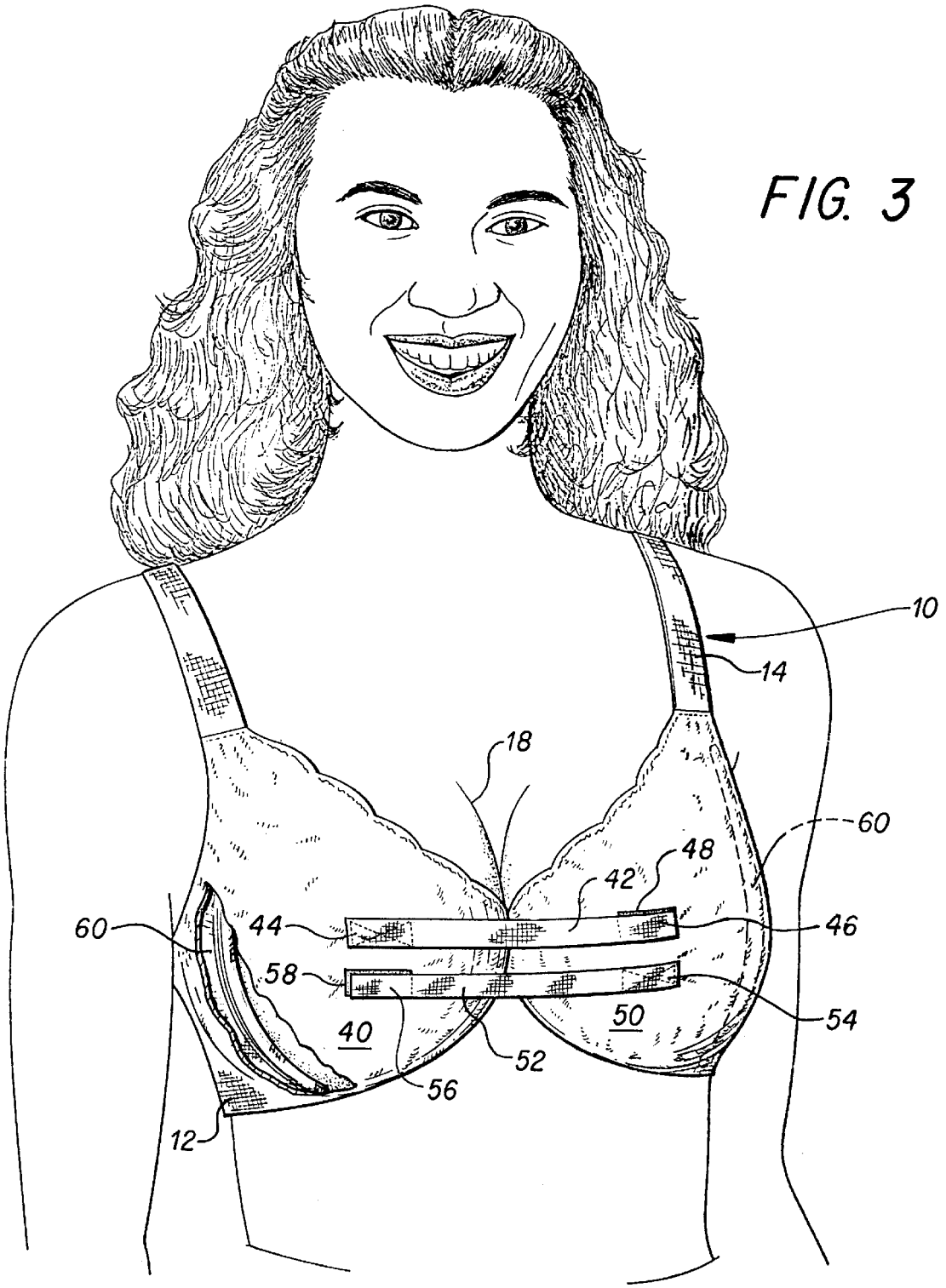
FIG. 3 is an environmental view of the second embodiment of the present invention showing the support straps in the connected position.

FIG. 3 shows the second embodiment of the present invention 10 in which the support straps, 42 and 52, are in a parallel configuration. This type of configuration pulls the breast pockets, 40 and 50, and the breasts towards each other to create and/or enhance the cleavage line 18. The second embodiment differs from the first embodiment mainly in the configuration of the support straps, but is essentially identical to the first embodiment in all other respects.

In the second embodiment, the first support strap 42 is connected at one end thereof to breast pocket 40 by stitching 44. Similarly, one end of the second support strap 52 is connected to breast pocket 50 by stitching 54. The support straps, 42 and 52, have one component of a hook-and-loop-type fastener, 46 and 56 respectively, located on their free ends. Complimentary component 48 of the hook-and-loop-type fastener for support strap 42 is located above where support strap 52 is connected to breast pocket 50. The complimentary component 55 of the hook-and-loop-type fastener for support strap 52 is located below where support strap 42 is connected to breast pocket 40. Components 48 and 58 of the hook-and-loop-type fasteners are larger in size than complimentary components and 56, or vice versa, in order to give the wearer the ability to adjust the tension in the support straps 42 and 52.

As shown in FIG. 3, either embodiment of the invention 10 may further include a pair of pads 60 removably or permanently inserted into a respective pocket, 20 and 40, to lift or direct the breasts toward each other, thereby further enhancing the wearer's cleavage line 18, particularly when the support straps, 22 and 32, are connected to a respective breast pocket. Alternatively, the pads 60 may be used in lieu of support straps 42, 52.

Both embodiments of the present invention are capable of being used with all varieties of brassiere styles and sizes to create and/or enhance the cleavage line. For example, the present invention can be used with padded, mini, and strapless brassieres.

It is to be understood that the present invention is not limited to the embodiments described above, but encompasses any and all embodiments within the scope of the following claims.

I claim:

1. A cleavage enhancing brassiere comprising:

a torso encircling band;

a first breast receiving pocket connected to said band;

a second breast receiving pocket connected to said band;

a first strap and a second strap, each said strap having a first end and a second end, said first end of said first strap being attached to said first breast receiving pocket, and said first end of said second strap being attached to said second breast receiving pocket;

first means for adjustably connecting said second end of said first strap to said second breast receiving pocket; and second means for adjustably connecting said second end of said second strap to said first breast receiving pocket;

wherein said first strap and said second strap are each attached in opposingly oriented directions and at an angular inclined relationship to said band.

2. The cleavage enhancing brassiere as defined in claim 1, wherein said first connecting means comprises a hook-and-loop-type fastener.

3. The cleavage enhancing brassiere as defined in claim 1, wherein said first strap is made from an elastic material.

4. The cleavage enhancing brassiere as defined in claim 1, wherein said first strap is made from a non-elastic material.

5. The cleavage enhancing brassiere as defined in claim 1, wherein said second connecting means comprises a hook-and-loop-type fastener.

6. The cleavage enhancing brassiere as defined in claim 1, wherein said second strap is made from an elastic material.

7. The cleavage enhancing brassiere as defined in claim 1, wherein said second strap is made from a non-elastic material.

8. The cleavage enhancing brassiere as defined in claim 1 further comprising a pair of breast-lifting pads inserted into a respective said breast receiving pocket, proximate the distal portion of each breast, to further direct the breasts toward each other.

9. The cleavage enhancing brassiere as defined in claim 1 wherein said torso encircling band is elastic.

* * * * *